US005341967A

United States Patent [19]

Silvenis

[11] Patent Number: 5,341,967

[45] Date of Patent: Aug. 30, 1994

[54] TRIGGER SPRAYER FOR UPRIGHT OR INVERTED DISPENSING WITHOUT LEAKAGE

[75] Inventor: Scott A. Silvenis, Midland, Mich.

[73] Assignee: Dowbrands Inc., Indianapolis, Ind.

[21] Appl. No.: 67,762

[22] Filed: May 26, 1993

[51] Int. Cl.[5] ..... B67D 5/40

[52] U.S. Cl. ..... 222/376; 222/383; 222/402.19

[58] Field of Search ..... 222/321, 383, 385, 402.19, 222/376, 500

[56] References Cited

U.S. PATENT DOCUMENTS

| | | | |
|---|---|---|---|
| 3,315,693 | 4/1967 | Bruan . | |
| 4,277,001 | 7/1981 | Nozawa | 222/402.19 X |
| 4,775,079 | 10/1988 | Grothoff | 222/402.19 X |
| 4,942,985 | 7/1990 | Schultz | 222/402.17 X |
| 5,119,974 | 6/1992 | Mann | 222/383 X |
| 5,125,543 | 6/1992 | Rohrabacher et al. | 222/500 X |
| 5,192,007 | 3/1993 | Blomquist | 222/383 X |
| 5,222,636 | 6/1993 | Meuresch | 222/402.19 X |

*Primary Examiner*—Gregory L. Huson

[57] ABSTRACT

This invention relates to a trigger sprayer dispenser which can be used to dispense liquids in multidirections. The present invention incorporates a mechanism in a conventional trigger sprayer to allow the sprayer to be used in an inverted position without the dispenser contents leaking through a sprayer vent orifice. The mechanism comprises a by pass chamber in communication with the chamber of the dip tube. The by pass chamber then creates an auxiliary fluid path to the dip tube fluid path when the dispenser is inverted. When the dispenser is inverted, the fluid remaining in the dip tube acts as a fluid lock thereby preventing internal dispenser air from escaping out from the dip tube into the trigger sprayer. The by pass mechanism therefore, also allows for more efficient evacuation of the dispenser contents.

3 Claims, 5 Drawing Sheets

TRIGGER SPRAYER FOR UPRIGHT OR INVERTED DISPENSING WITHOUT LEAKAGE

This invention relates to a trigger sprayer dispenser which can be used to dispense liquids in multidirections that is, the trigger sprayer dispenses efficiently in a multitude of positions.

Trigger sprayers currently available typically can only be used in an upright position without leaking, making such trigger sprayers unsuitable for many desirable applications. If the sprayer dispenser is inverted, the dip tube which serves to draw the liquid from the bottom of the dispenser is caused to draw air but not liquid. Additionally, when the sprayer is inverted, the liquid will leak through the sprayer vent orifice in the trigger sprayer. The sprayer vent orifice allows for air to enter into the upright dispenser to replace the dispensed liquid. Such leaking is undesirable to the user particularly if the liquid in the dispenser is irritating to the skin or stain causing in any way.

An object of the present invention is to provide a new and improved multidirectional trigger sprayer. Another object of the present invention is to provide a trigger sprayer which provides more complete liquid evacuation of the dispenser in an inverted position as well as an upright position. Another object of the present invention is to incorporate a mechanism for allowing the sprayer to be used in an inverted position without the dispenser contents leaking through the sprayer vent orifice.

Accordingly, the new multidirectional trigger sprayer comprises a by pass chamber in communication with the chamber of the dip tube. The by pass chamber then creates an auxiliary fluid path to the dip tube fluid path when the dispenser is inverted. When the dispenser is inverted, the fluid remaining in the dip tube acts as a fluid lock thereby preventing internal dispenser air from escaping out from the dip tube into the trigger sprayer.

Thus, accordingly, the multidirectional trigger sprayer comprises a conventional trigger sprayer having an attachment thereto which comprises a by pass chamber in communication with the chamber of the dip tube and having a flow check means therein allowing for control of the fluid flow from the dispenser. The fluid flow is controlled by preferably positioning the upper end of the by pass chamber immediately below the conventional trigger apparatus at the upper end of the dip tube to enable for substantially complete liquid evacuation of the dispenser when the dispenser is inverted. More specifically, the multidirectional sprayer comprises tandemly arranged chambers, one acting as a sprayer dip tube chamber and the other as the by pass chamber. The dip tube is in communication with both chambers. The by pass chamber comprises: (i) an orifice in the upper end of the chamber in communication with the sprayer vent, (ii) a flow check means such as a by pass ball or weighted diaphragm which will freely move with gravity from the lower end of the chamber when the dispenser is in an upright position to the upper end of the chamber when the dispenser is in an inverted position, (iii) a by pass orifice in communication with the dip tube and the inner wall of the chamber at the lower end of the chamber and (iv) a by pass dispenser orifice in communication with the dispenser and the outer wall of the chamber also in the lower end of the chamber, just above the flow check means when the dispenser is in the upright position.

When the trigger sprayer operates in an upright fashion, the by pass means seals at the by pass dip tube orifice allowing for fluid to by pass the by pass chamber and flow directly up from the dip tube into the dip tube chamber and through the trigger sprayer in a conventional manner. The sprayer vent orifice and by pass dispenser orifice, which in conjunction expose the inside of the dispenser to the outside of the dispenser, are left unobstructed above the by pass means to allow the vacuum created within the dispenser to be offset when the trigger sprayer is operated. The sprayer in this position acts in a customary trigger sprayer fashion. The product fluid passes up the dip tube which communicates with both chambers into the dip tube chamber and eventually out the trigger sprayer orifice.

However, when the sprayer is used in an inverted position, the by pass means seals off the sprayer vent orifice to prevent fluid from leaking through the sprayer vent orifice out from the dispenser. The by pass means exposes the by pass dip tube orifice and the by pass dispenser orifice allowing for fluid to flow from the dispenser through the by pass dispenser orifice immediately into the dip tube chamber and by passing the dip tube. The fluid held in the dip tube acts as a fluid lock to prevent air from traveling up the dip tube so only the fluid then passes directly from the dispenser into the dip tube chamber and out the trigger sprayer dispensing orifice. Thus, the by pass dispenser orifice serves two functions: (i) the by pass dispenser orifice in conjunction with the sprayer vent orifice offsets the vacuum from within the upright dispenser caused by the fluid displacement and (ii) draws fluid from the dispenser directly to the sprayer by passing the dip tube when the dispenser is inverted.

More specifically when the by pass check means is a by pass check ball and the trigger sprayer operates in an upright fashion, the by pass check ball seats in a down position over the by pass dip tube orifice, leaving the sprayer vent orifice and by pass dispenser orifice unobstructed. The fluid then by passes the by pass chamber and flows directly up from the dip tube into the dip tube chamber and through the trigger sprayer in a conventional manner. Simultaneously, the internal vacuum will be offset through the by pass dispenser orifice and the sprayer vent orifice. The sprayer in this position acts in a customary trigger sprayer fashion. The product fluid passes up the dip tube which communicates with both chambers into the dip tube chamber and eventually out the trigger sprayer orifice.

However, when the sprayer is used in an inverted position the ball drops to the upper end of the by pass chamber where the by pass check ball seats over the sprayer vent orifice to prevent fluid from leaking through the sprayer vent orifice. The by pass check ball seats away from the by pass dip tube orifice and the by pass dispenser orifice allowing for fluid to flow from the dispenser through the by pass dispenser orifice immediately into the dip tube chamber by passing the dip tube. The fluid in the dip tube acts as a fluid lock to prevent air from being drawn through the dip tube into the dip tube. Thus, the fluid then passes directly from the dispenser into the dip tube chamber and out the trigger sprayer dispensing orifice. When the sprayer is then returned to an upright position and the trigger is pressed inward, the sprayer vent orifice allows air into the dispenser and offsets the vacuum caused by the fluid displacement.

When the by pass check means is a weighted diaphragm and the trigger sprayer operates in an upright fashion, the diaphragm flips in a down position because of gravity acting on the weighted end, and is sealed in place just below the by pass dispenser orifice, leaving the sprayer vent orifice free to vent through the by 0 pass dispenser orifice. This in turn allows for fluid to by pass the by pass chamber and flow directly up from the dip tube into the dip tube chamber and through the trigger sprayer in a conventional manner, simultaneously allowing for the vacuum to offset through the sprayer vent orifice. The sprayer in this position acts in a customary trigger sprayer fashion. The product fluid passes up the dip tube which communicates with both chambers into the dip tube chamber and eventually out the trigger sprayer orifice.

However, when the sprayer is used in an inverted position the weighted end of the diaphragm drops to the upper end of the by pass chamber where the weighted diaphragm seals off the sprayer vent orifice but allows the by pass dispenser orifice to be unobstructedly in communication with the by pass dip tube orifice and dip tube chamber. The weighted diaphragm is sealed in place to prevent fluid from leaking out of the dispenser from the by pass dispenser orifice through the sprayer vent orifice. The weighted diaphragm opens the by pass dispenser orifice to the by pass chamber allowing for fluid to flow from the dispenser immediately into the dip tube chamber and by pass the dip tube. The fluid lock in the dip tube prevents air from being drawn into the dip tube so that the fluid then passes directly from the dispenser into the dip tube chamber and out the trigger sprayer dispensing orifice. When the sprayer is then returned to an upright position the weighted diaphragm again flips and the sprayer vent orifice is open to the by pass dispenser orifice. When the trigger is then pressed inward, air is allowed into the dispenser and offsets the vacuum created by the displaced fluid.

For an augmented understanding of the nature and objects of the invention reference should be made to the following description taken in connection with the accompanying drawings wherein.

The following figures are embodiments of the invention but are not meant to be limiting to the scope of the invention. The by pass chamber and by pass means can be used in and modified for various types of sprayer dispensers, the following are just examples of a by pass system incorporated into currently available sprayers.

DETAILED DESCRIPTION

Figure 1:
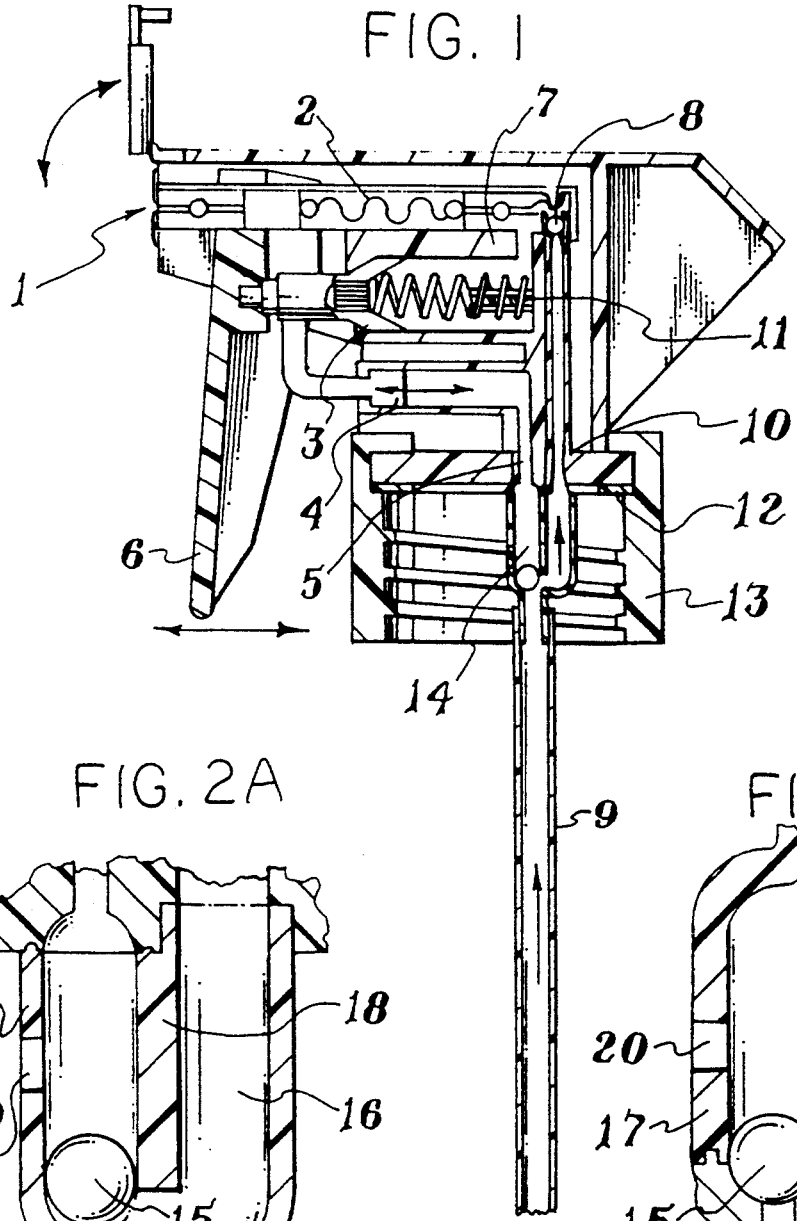
FIG. 1 is a cross-sectional side view of one embodiment of a trigger sprayer of the present invention.
Figure 2A:
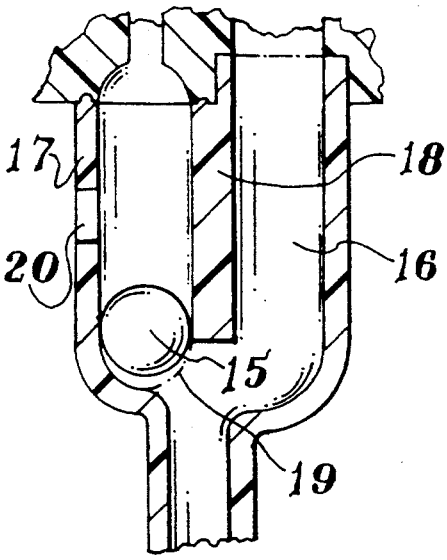
FIG. 2A is an enlarged cross-sectional view of a portion of the trigger sprayer of FIG. 1 showing a by-pass system of the trigger sprayer.

Referring to FIG. 1 the embodiment of the sprayer dispenser of this invention is shown comprising a standard design for a trigger sprayer having: a nozzle (1) the orifice of which regulates the spray and the shut off of the fluid; a spinner (2) which regulates the second valve and directs the spray; a chamber piston (3) which determines the volume and creates the suction and pressure on the fluid and a venting piston (4) which vents the dispenser through the sprayer vent orifice (5); a trigger (6) which actuates the chamber and venting piston simultaneously on a pressure stroke; the pump housing (7) which is the main body of the sprayer; the sprayer check ball (8) which is the first valve and provides check on the pressure stroke; the dip tube (9) which conveys liquid to the sprayer; the valve case (10) which provides a seat for the sprayer check ball and retains the dip tube chamber; the piston spring (11) which creates the suction and provides return of the piston trigger on pressure strokes; the cap seal (12) which provides the seal between the sprayer and dispenser finish and the dispenser cap (13) which fastens the sprayer to the dispenser container. As shown in FIG. 2A, the by pass system of the trigger sprayer of the present invention comprises the by pass chamber (14) which contains the by pass means (15) specifically a by pass check ball and a dip tube chamber (16) The by pass chamber comprises: an outer wall (17); and an inner wall (18); as well as a by pass dip tube orifice (19) which communicates the by pass chamber with the dip tube at the base of the inner wall of the by pass chamber; and a by pass dispenser orifice (20) through the outer wall of the by pass chamber which communicates the by pass chamber directly with the contents of the dispenser. The by pass dispenser orifice is just above the by pass check ball when the by pass check ball is in a seated position over the by pass dip tube orifice.

The by pass dip tube orifice and the dip tube chamber communicate with the dip tube. The dip tube as in this embodiment, may be offset with respect to both chambers. Therefore when the sprayer dispenser is held in an upright position the user depresses the trigger inwardly, the depression causes the chamber piston and venting piston to move inwardly and the fluid in the chamber piston is forced out of the trigger sprayer orifice. Simultaneously, the venting piston causes the dispenser container to return to atmospheric pressure by exposing the sprayer vent orifice to the outside of the dispenser container. The return movement of the trigger caused by the piston spring then creates the vacuum to force liquid from the dispenser into the dip tube through the dip tube chamber to refill the chamber piston.

Figure 3:
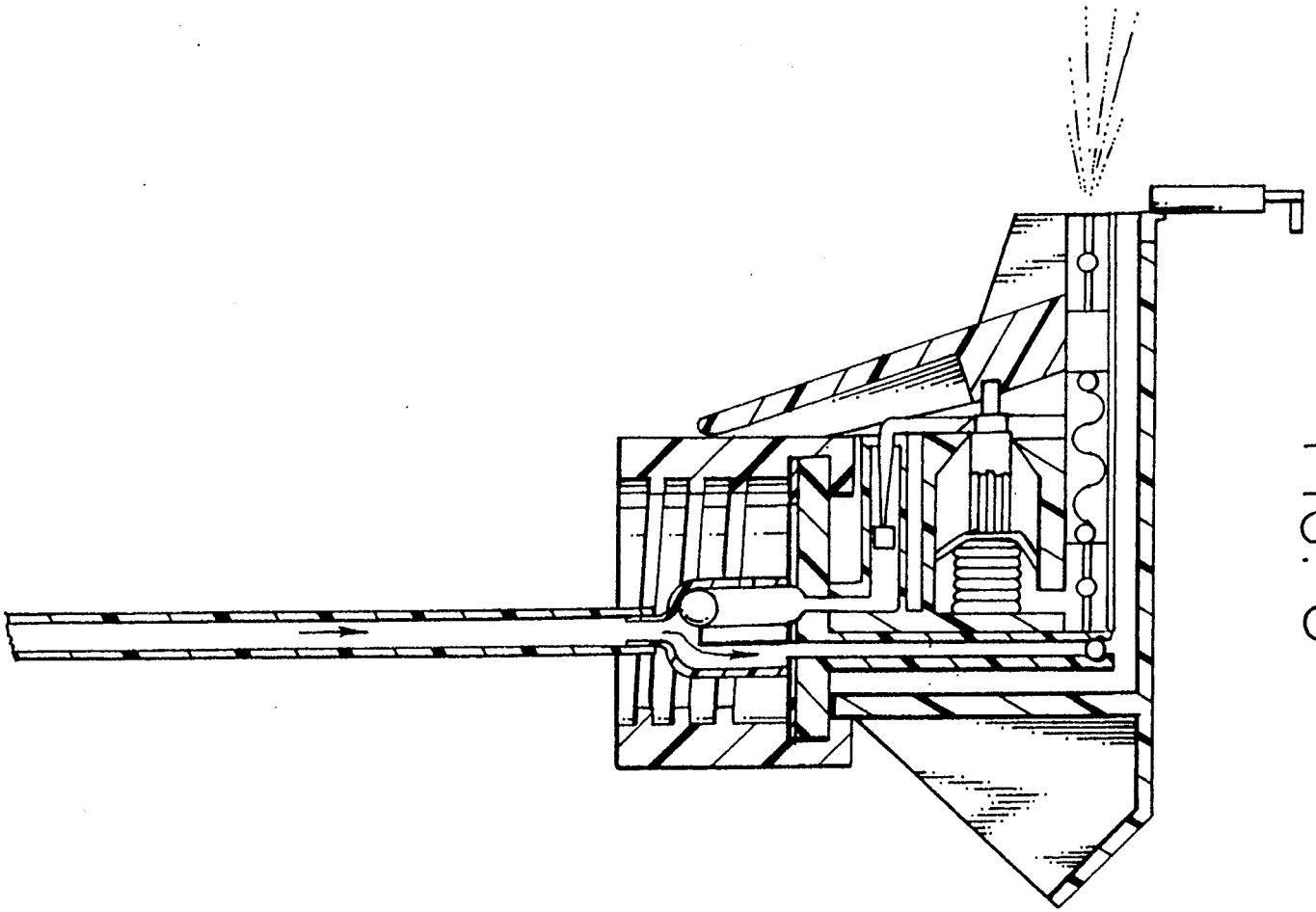
FIG. 3 is a cross-section side view of the trigger sprayer, of FIG. 1 showing the trigger sprayer in use in an upright position.

When the sprayer is used in an upright manner (FIG. 3), the fluid flow occurs through the dip tube, the by pass means seals off the by pass chamber and fluid flows into the dip tube chamber directly from the dip tube. Essentially, the trigger sprayer in this upright position dispenses the product in substantially the same manner as an ordinary trigger sprayer. In this upright position, the by pass check ball by reason of its own weight, is seated to seal off the by pass dip tube orifice allowing for fluid to by pass the by pass chamber and flow directly up from the dip tube into the dip tube chamber and through the trigger sprayer in a conventional manner. The sprayer in this position acts in a customary trigger sprayer fashion. The product fluid passes up the dip tube which communicates with both chambers into the dip tube chamber and out the trigger sprayer orifice.

Figure 2B:
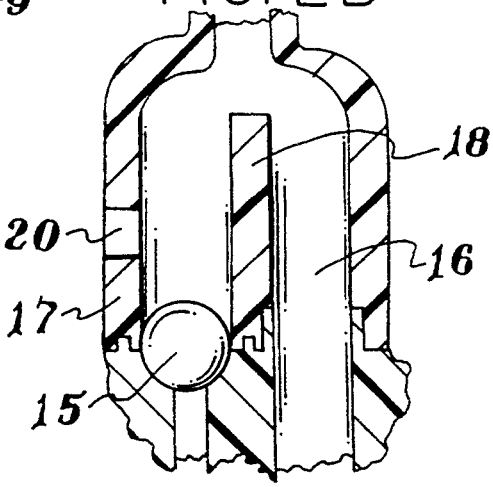
FIG. 2B is an enlarged cross-sectional view of a portion of the trigger sprayer of FIG. 1 showing a by-pass system of the trigger sprayer in an inverted position.
Figure 4:
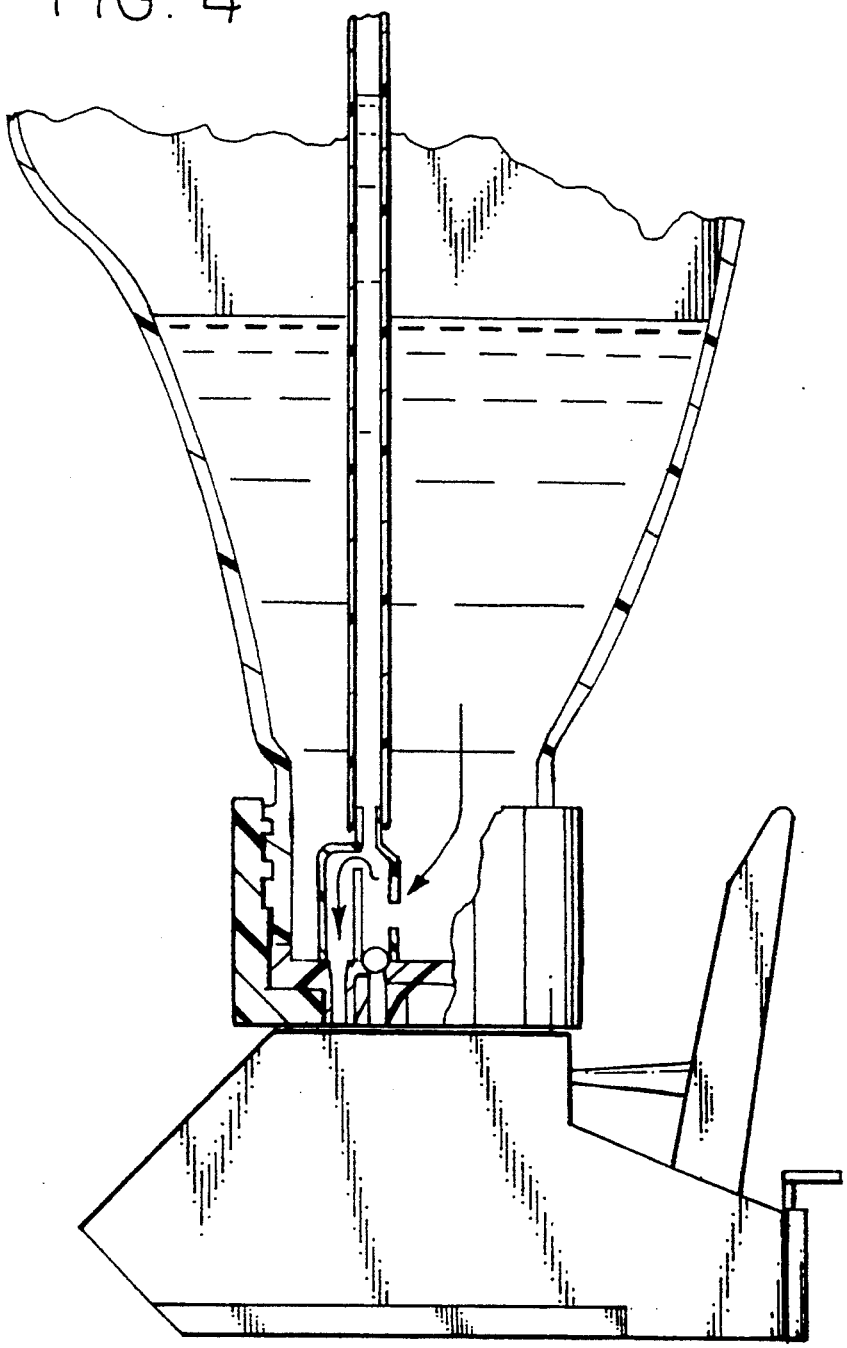
FIG. 4 is a partly cross-sectional, partly broken away view of a portion of a trigger sprayer of the present invention in an inverted position.

However, when the sprayer is used in an inverted position (FIGS. 4 and 2B) the ball moves, again essentially by reason of its own weight, to the upper end of the by pass chamber where the ball seats over the sprayer vent orifice and seals off the sprayer vent orifice to prevent fluid from leaking from the sprayer vent orifice through the by pass dispenser orifice from within the dispenser to the outside of the dispenser.

Simultaneously, because the by pass check ball moves to be seated over the sprayer vent orifice the by pass dispenser orifice is free to accept liquid directly from the dispenser. Thus, when the dispenser is used in an inverted position the fluid flows to the top of the dispenser container where it moves into the by pass chamber through the by pass dispenser orifice so long as 0 the depth of the liquid exceeds the distance between the upper end of the by pass chamber and the top of the dip tube chamber. Therefore, in an inverted position, the by pass check ball seats away from the by pass dip tube orifice and the by pass dispenser orifice allowing for fluid to flow from the dispenser immediately into the dip tube chamber by passing the dip tube. The fluid then passes into the dip tube chamber and out the trigger sprayer dispensing orifice. Therefore, by designing the top of the dispenser in close proximity to the by pass chamber and dip tube chamber, substantially complete emptying of the dispenser is effected without leaking when the dispenser is inverted.

Figure 6:
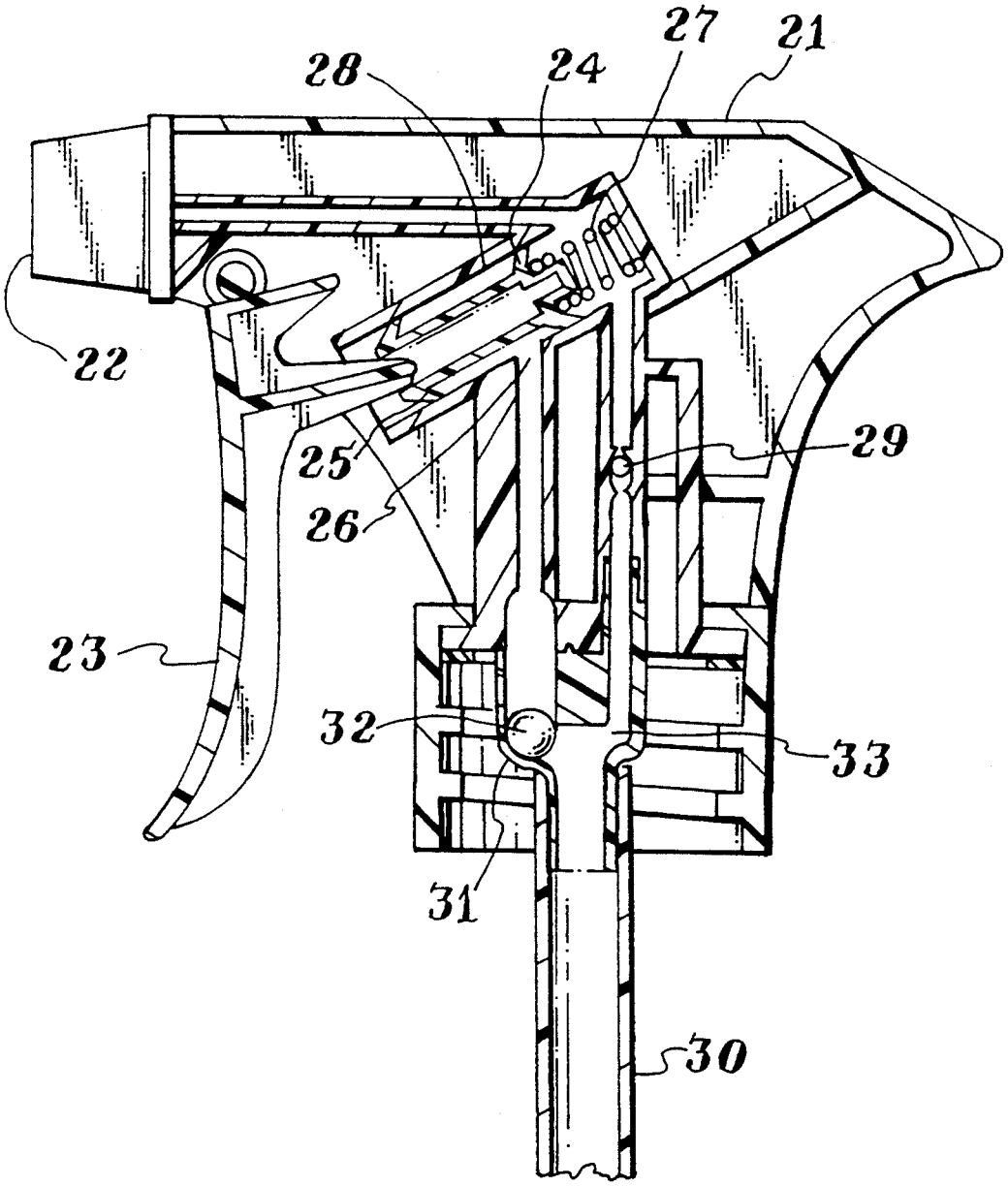
FIG. 6 is a cross-sectional side view of another embodiment of a trigger sprayer of the present invention.

The trigger sprayer of FIG. 6 incorporates a sprayer different from that of the sprayer of FIG. 1. The trigger sprayer of FIG. 6 comprises: a shroud (21) a nozzle (22), the orifice of which regulates the spray and the shut off of the fluid; a trigger (23) which actuates the piston on a pressure stroke; a chamber piston (24) with a venting flange (25); a venting orifice (26); the piston spring (27) which creates the suction and provides return of the piston trigger on suction strokes; the valve body (28) which houses the spring and the piston; the sprayer check ball (29) which is the first valve and provides check on the pressure stroke; the dip tube (30) which conveys liquid to the sprayer; the by pass chamber (31) which contains the by pass means ( 32 ) and a dip tube chamber ( 33 ). The by pass chamber is the same as that shown in FIG. 2A.

Figure 5A:
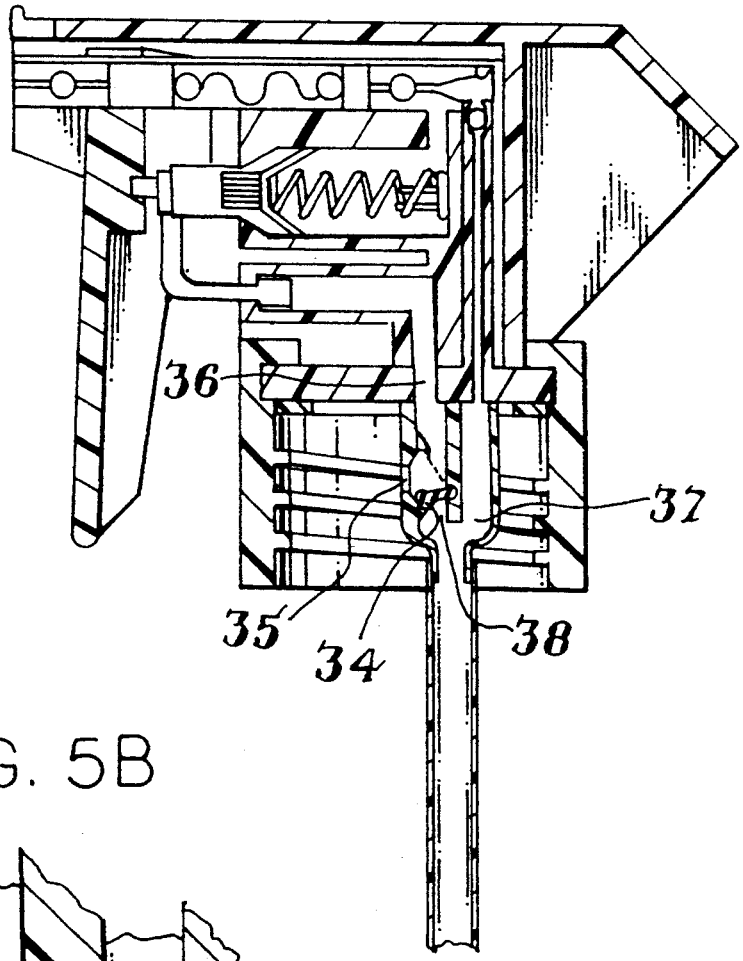
FIG. 5A is a cross-sectional side view of another embodiment of a trigger sprayer of the present invention.
Figure 5B:
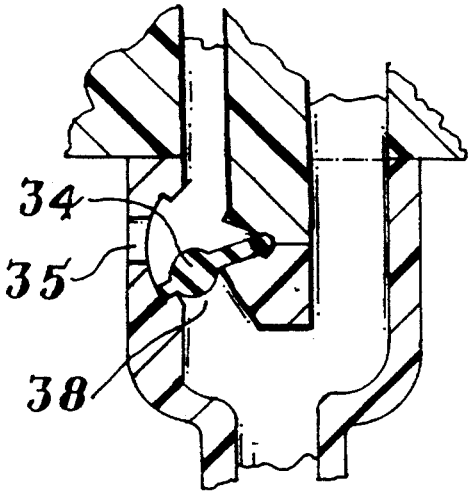
FIG. 5B is an enlarged cross-sectional view of a portion of another embodiment of a trigger sprayer of the present invention showing a weighted diaphragm mechanism as a by-pass means.

FIGS. 5A and 5B show two different embodiments for weighted diaphragm (34) mechanisms as by pass means. FIG. 5A shows a weighted diaphragm as a by pass means for the invertible sprayer which seals on the inside wall of the by pass chamber and the weighted diaphragm of FIG. 5B seals within the inside wall of the by pass chamber as a plug to the by pass dip tube orifice.

When the trigger sprayer operates in an upright fashion, the diaphragm flips (as shown in FIG. 5A) in a down position because of gravity acting on the weighted end, and is sealed in place just past the by pass dispenser orifice (35), leaving the sprayer vent orifice free (36) to vent through the by pass dispenser orifice. This in turn allows for fluid to by pass the by pass chamber and flow directly up from the dip tube into the dip tube chamber (37) and through the trigger sprayer in a conventional manner and simultaneously allowing for the vacuum to offset through the sprayer vent orifice. The sprayer in this position acts in a customary trigger sprayer fashion. The product fluid passes up the dip tube which communicates with both chambers into the dip tube chamber and eventually out the trigger sprayer orifice.

However, when the sprayer is used in an inverted position the weighted end of the diaphragm drops to the upper end of the by pass chamber where the weighted diaphragm seals past the by pass dispenser orifice and is sealed in place to prevent fluid from leaking out of the dispenser from the by pass dispenser orifice through the sprayer vent orifice. The weighted diaphragm opens the by pass dispenser orifice to the by pass chamber allowing for fluid to flow from the dispenser immediately through the by pass dip tube orifice (38) into the dip tube chamber and by pass the dip tube. The fluid lock in the dip tube prevents air from being drawn into the dip tube so that the fluid then passes directly from the dispenser into the dip tube chamber and out the trigger sprayer dispensing orifice. When the sprayer is then returned to an upright position the weighted diaphragm again flips and the sprayer vent orifice is open to the by pass dispenser orifice which when the trigger is pressed inward, allows air into the dispenser and offsets the vacuum in the dispenser.

What is claimed is:

1. A trigger sprayer dispenser having a capacity to operate upright or inverted without leaking comprising a by pass chamber having an upper portion and lower portion when the sprayer is in an upright position which comprises; (i) a sprayer vent orifice in the upper portion of the chamber in communication with a sprayer vent, (ii) a flow check means which will freely move with gravity from the lower portion of the chamber when the dispenser is in an upright position to the upper portion of the chamber when the dispenser is in an inverted position, (iii) a by pass orifice in communication with the dip tube at the lower portion of the by pass chamber and (iv) a dispenser by pass orifice in communication with the dispenser and the by pass chamber, in the lower portion of the chamber just above the flow check means when the dispenser is in the upright position, wherein said flow check means seals against said sprayer vent orifice when said trigger sprayer dispenser is inverted to prevent leakage of fluid through the sprayer vent.

2. The trigger sprayer of claim 1 wherein said flow check means is a by pass check ball.

3. The trigger sprayer of claim 1 wherein said flow check means is a weighted diaphragm.

* * * * *